US006932284B2

(12) United States Patent
Cristiani et al.

(10) Patent No.: US 6,932,284 B2
(45) Date of Patent: Aug. 23, 2005

(54) ELECTROMAGNETIC FUEL INJECTOR FOR AN INTERNAL COMBUSTION ENGINE WITH A MONOLITHIC TUBULAR MEMBER

(75) Inventors: Marcello Cristiani, Imola (IT); Mirco Vignoli, Zola Predosa (IT)

(73) Assignee: Magneti Marelli Powertrain S.p.A., Viale Aldo Borletti (IT)

( * ) Notice: Subject to any disclaimer, the term of this patent is extended or adjusted under 35 U.S.C. 154(b) by 70 days.

(21) Appl. No.: 10/732,810

(22) Filed: Dec. 11, 2003

(65) Prior Publication Data

US 2004/0169095 A1 Sep. 2, 2004

(30) Foreign Application Priority Data

Dec. 12, 2002 (IT) ..... BO20020778

(51) Int. Cl.[7] ..... B05B 1/30

(52) U.S. Cl. ..... 239/585.1; 239/585.4; 239/900; 251/129.15; 251/129.21

(58) Field of Search ..... 239/585.1–585.5, 239/900; 251/129.15, 129.16, 129.19, 129.21

(56) References Cited

U.S. PATENT DOCUMENTS 6,032,879 A * 3/2000 Hamada et al. ..... 239/585.1
6,431,474 B2 * 8/2002 Fochtman et al. ..... 239/585.4
6,464,153 B1 10/2002 Bonnah, II et al.
2002/0130206 A1 9/2002 Kobayashi et al.

FOREIGN PATENT DOCUMENTS

JP 2002206468 7/2002
WO WO 94/19599 9/1994

* cited by examiner

*Primary Examiner*—Dinh Q. Nguyen
(74) *Attorney, Agent, or Firm*—Nath & Associates PLLC; Gary M. Nath; Gregory B. Kang

(57) ABSTRACT

An electromagnetic fuel injector for an internal combustion engine, comprising a main body having a central cylindrical cavity adapted to act as a duct for the fuel, a valve which is disposed to close an end of the central cylindrical cavity and is provided with a moving shutter, an electromagnetic actuator which is provided with a coil, a fixed armature, and a moving armature mechanically connected to the shutter and adapted to be magnetically attracted by the fixed armature against the action of a spring, and a monolithic tubular member which is disposed coaxially within the central cylindrical cavity and houses the fixed armature and the moving armature.

11 Claims, 2 Drawing Sheets

ELECTROMAGNETIC FUEL INJECTOR FOR AN INTERNAL COMBUSTION ENGINE WITH A MONOLITHIC TUBULAR MEMBER

The present invention relates to an electromagnetic fuel injector for an internal combustion engine.

BACKGROUND OF THE INVENTION

An electromagnetic fuel injector comprises a main body having a central cylindrical cavity which acts as a duct for the fuel and ends in a valve adapted to regulate the flow of fuel and provided with a moving shutter controlled by an electromagnetic actuator. The main body is made from ferromagnetic material and houses a coil of the electromagnetic actuator. A fixed armature and a moving armature of the ferromagnetic actuator are disposed in the central cavity and are made from ferromagnetic material. In operation, the fixed armature is adapted magnetically to attract the moving armature against the action of a spring in order to cause a displacement of the shutter which is mechanically rigid with this moving armature. It will be appreciated that, because a force of magnetic attraction is generated between the fixed armature and the moving armature, it is necessary for the fixed armature and the moving armature to be traversed by the magnetic flux generated by the coil.

In order to try to reduce the magnetic flux dispersed, i.e. to try to reduce the magnetic flux generated by the coil which does not impinge on the fixed armature or the moving armature, at least one insert of non-ferromagnetic material (metal or plastic) is provided in the main body and is adapted to create a barrier to the passage of the magnetic flux so as to force this magnetic flux to pass through the fixed armature and the moving armature. However, the production of the insert from non-ferromagnetic material requires special processing which substantially increases the cost of the injector; moreover, at the junctions between the insert of non-ferromagnetic material and the main body there may be leakages of fuel.

As an alternative to the above-described use of an insert of non-ferromagnetic material, it is possible appropriately to shape the main body in order to create air gap zones adapted to perform the same function of creating a barrier to the passage of the magnetic flux in order to force this magnetic flux to pass through the fixed armature and the moving armature. However, the production of these air gap zones in the main body is laborious and complex.

US2002130206 discloses a fuel injector including a tubular casing having an axial fuel passage; disposed within the fuel passage are a valve seat element, a core cylinder, and a valve element axially moveably disposed therebetween and opposed to the core cylinder with an axial air gap. An electromagnetic actuator cooperates with the casing, the valve element and the core cylinder to form a magnetic field forcing the valve element to the open position against a spring between the valve element and the core cylinder upon being energized. The casing includes a reluctance portion producing an increased magnetic reluctance and allowing the magnetic field to extend to the valve element and the core cylinder through the air gap; the reluctance portion has a reduced radial thickness and an axial length extending over the air gap.

JP2002206468 discloses an injection port, which is opened and closed by a valve element, and an armature connected to the rear end of a movable body, to which the valve element is fixed; a fixed core is arranged inside the magnetic pipe, at a position opposite to a rear end surface of the armature. The valve element is energized in the closing direction by a coil spring, and a solenoid coil is arranged outside the magnetic pipe; the magnetic pipe as a whole is formed of a magnetic material.

WO9419599 discloses a fuel injector having combination valve-armature fabricated by laser welding relatively more magnetically permeable armature element to relatively less magnetically permeable valve element. Valve element contains sealing ring and landing ring, the latter being circumferentially discontinuous because of fuel passage holes through valve element, the former being non-symmetrical so that magnetic opening force causes valve-armature to open by tilting about consistent circumferential location on valve element.

SUMMARY OF THE INVENTION

The object of the present invention is to provide an electromagnetic fuel injector for an internal combustion engine which is free from the drawbacks described above and, in particular, is simple and economic to produce.

The present invention therefore relates to an electromagnetic fuel injector for an internal combustion engine in accordance with claim 1.

BRIEF DESCRIPTION OF THE DRAWINGS

The present invention will now be described with reference to the accompanying drawings, which show a non-limiting embodiment thereof, and in which.

DETAILED DESCRIPTION OF THE INVENTION

Figure 1:
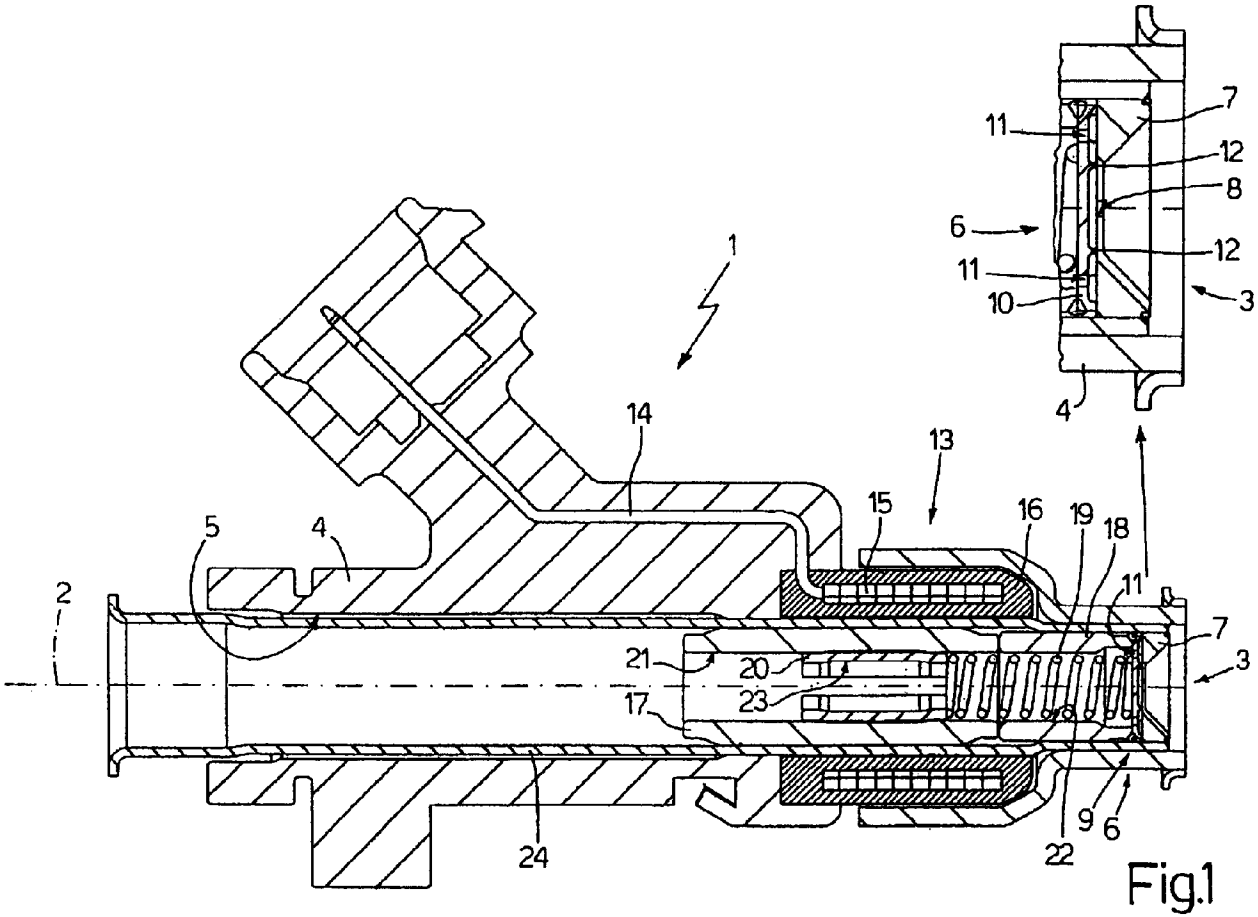
FIG. 1 is a diagrammatic view, in lateral elevation and cross-section along a first plane of section of a fuel injector of the present invention.

In FIG. 1, a fuel injector is shown overall by 1, and is substantially cylindrically symmetrical about a longitudinal axis 2 and is adapted to be controlled to inject fuel from its injection nozzle 3. The injector 1 comprises a main body 4, made substantially from ferromagnetic material, which comprises, along its entire length, a central cylindrical cavity 5 which is adapted to act as a duct for the fuel and ends in the injection nozzle 3; the terminal end of the cylindrical cavity 5 is closed by a valve 6 which comprises a valve seat 7 having a central injection hole 8 which defines the injection nozzle 3 and a shutter 9 which can move between a position opening and closing the central hole 8 in order to regulate the flow of fuel through the injection nozzle 3. The shutter 9 comprises a moving plate 10 which has at least one peripheral supply hole 11 and a sealing member 12 which is circular in shape, projects from the plate 10 and is adapted to isolate the supply hole 11 from the injection hole 8 when the shutter 9 is disposed in the closed position bearing on the valve seat 7.

The main body 1 further houses an electromagnetic actuator 13 which is supplied by a control unit (not shown) via an electrical cable 14 in order to displace the shutter 9 of the valve 6 between the positions opening and closing this valve 6. The electromagnetic actuator 13 comprises a coil 15 disposed coaxially about the central cylindrical cavity 5 and enclosed in a toroidal housing 16 of plastic material, a fixed armature 17 which is magnetically coupled to the coil 15 and is made from a ferromagnetic material, and a moving armature 18 which is made from a ferromagnetic material, is mechanically connected to the shutter 9 and is adapted to be magnetically attracted by the fixed armature against the action of a spring 19; the spring 19 is, in particular, compressed between an abutment body 20 rigid with the fixed armature 17 and the plate 10 of the shutter 9 and tends to urge the plate 10 of the shutter 9 against the valve seat 7 in order to keep the valve 6 in the closed position.

The fixed armature 17 and the moving armature 18 of the electromagnetic actuator have respective central holes 21 and 22, which are coaxial with one another, have the same dimension, and are adapted both to house the spring 19 with the relative abutment body 20, and to allow fuel to flow to the valve 6; for this purpose, the abutment body 20 has a central through hole 23. The plate 10 of the shutter 9 is welded to a wall of the moving armature 18, so as to dispose its own supply hole 11 in communication with the central hole 22 of this moving armature 18.

Lastly, the injector 1 comprises a monolithic tubular member 24 which is made from a ferromagnetic material, has an axial length substantially equal to the axial length of the central cylindrical cavity 5, and is disposed coaxially within this central cylindrical cavity 5 in order internally to house the fixed armature 17, the moving armature 18, the spring 19 and the valve 6.

According to an embodiment which is not shown, the injector 1 is provided with a non-return device interposed between the fixed armature 17 and the moving armature 18 of the electromagnetic actuator 13 and an atomiser coupled to the valve 6.

In operation, when the coil 15 of the electromagnetic actuator 13 is not excited, the fixed armature 17 and the moving armature 18 are not substantially impinged upon by a magnetic field and, therefore, the fixed armature 17 does not exert a force of attraction on the moving armature 18, which is urged by the spring 19 against the valve 6; in this situation, the plate 10 of the shutter 9 is urged into contact against the valve seat 7 and the fuel cannot therefore flow though the injection hole 8 (closed position of the valve 6). When the coil 15 of the electromagnetic actuator 13 is excited, a magnetic field is generated and impinges upon the fixed armature 17 and the moving armature 18, which is magnetically attracted by the fixed armature 17 together with the shutter 9 thus enabling fuel to flow through the injection hole 8 (open position of the valve 6).

Figure 2:
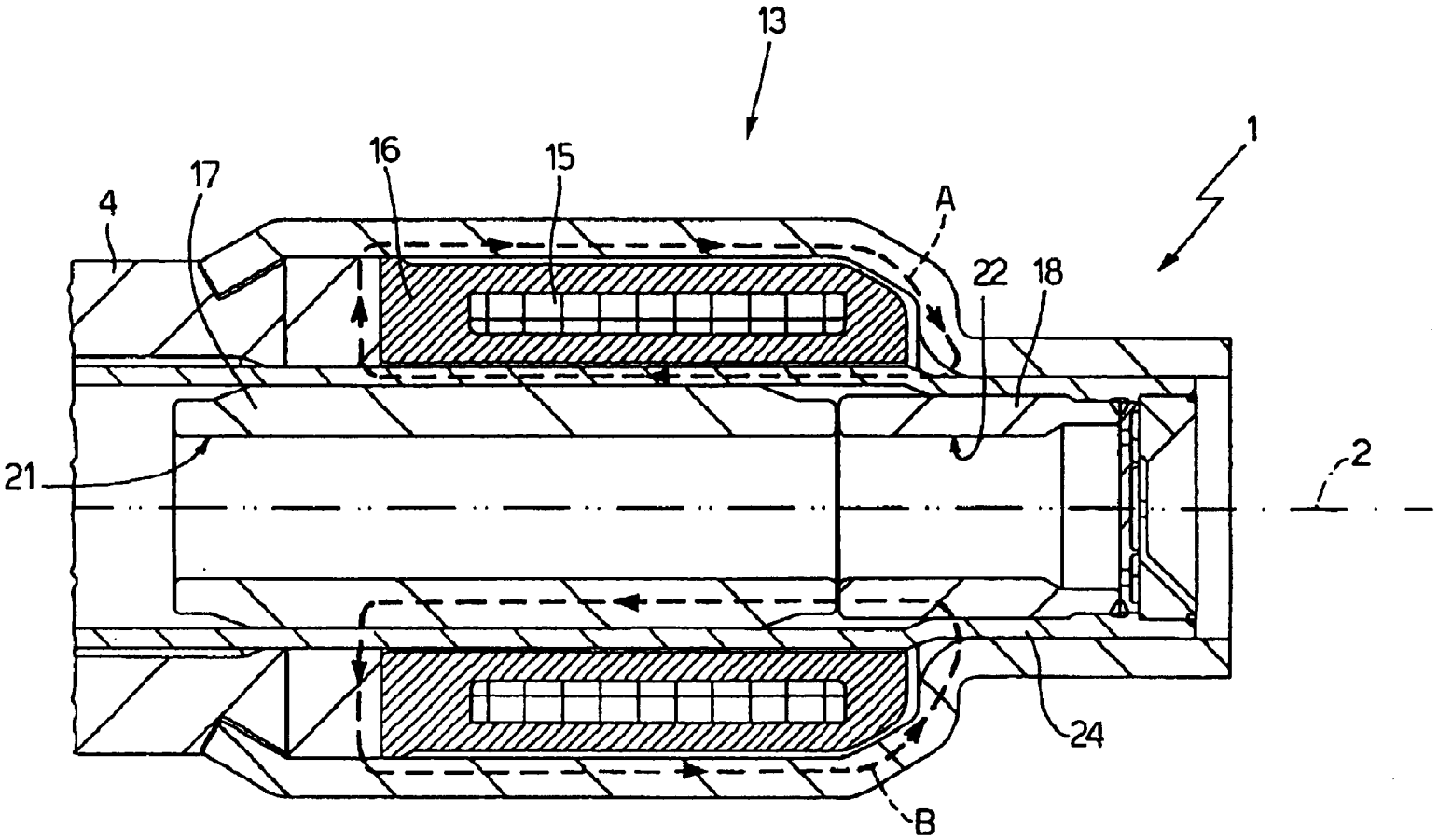
FIG. 2 is a view on an enlarged scale, in cross-section along a second plane of section (perpendicular to the first plane of section), with some parts removed for clarity, of an electromagnetic actuator of the injector of FIG. 1, in which the paths of the magnetic flux generated by a coil of an electromagnetic actuator are shown.

In FIG. 2, letter A shows a field line relative to a dispersed magnetic flux, i.e. a magnetic flux generated by the coil 16, which does not impinge upon the fixed armature 17 or the moving armature 18, and letter B shows a field line relative to a working magnetic flux, i.e. to a magnetic flux generated by the coil 16 which impinges upon the fixed armature 17 and the moving armature 18. By appropriately dimensioning both the section of the tubular member 24 with respect to the section of the fixed armature 17 and the moving armature 18, and the position of the fixed armature 17 and the moving armature 18 with respect to the coil 15, it is possible to reduce the quantity of magnetic flux dispersed to a very low value to the benefit of the quantity of working magnetic flux. Experimental tests have shown, in particular, that by using a ratio of 1:4 between the section of the tubular member 24 and the section of the fixed armature 17 and the moving armature 18, the quantity of magnetic flux dispersed does not exceed 20% of the total quantity of flux generated by the coil 15.

In order further to reduce the quantity of magnetic flux dispersed, it is possible to produce the fixed armature 17 and the moving armature 18 from a first ferromagnetic material and to produce the tubular member 24 from a second ferromagnetic material having a magnetic permeability lower than the first ferromagnetic material.

As a result of the presence of the tubular body 24, the injector 1 is simple and economic to produce and, at the same time, fuel leakages are cancelled out while keeping the quantity of magnetic flux dispersed at a low level.

What is claimed is:

1. An electromagnetic fuel injector (1) for an internal combustion engine; the injector (1) comprising a main body (4) having a central cylindrical cavity (5) adapted to act as a duct for the fuel, a valve (6) which is disposed to close an end of the central cylindrical cavity (5) in order to regulate the flow of fuel and is provided with a moving shutter (9), and an electromagnetic actuator (13) which is provided with a coil (15) disposed coaxially about the central cylindrical cavity (5), a fixed armature (17) of ferromagnetic material, and a moving armature (18) of ferromagnetic material mechanically connected to the shutter (9) and adapted to be magnetically attracted by the fixed armature (17) against the action of a spring (19); the injector (1) further comprising a monolithic tubular member (24) which is made from ferromagnetic material, is disposed coaxially within the central cylindrical cavity (5) of the main body (4) and houses the fixed armature (17) and the moving armature (18) of the electromagnetic actuator (13); the injector (1) being characterised in that the fixed armature (17) and the moving armature (18) are made from a first ferromagnetic material, while the tubular member (24) is made from a second ferromagnetic material having a lower magnetic permeability than the first ferromagnetic material.

2. An injector (1) as claimed in claim 1, in which the monolithic tubular member (24) has an axial length substantially equal to the axial length of the central cylindrical cavity (5).

3. An injector (1) as claimed in claim 1, in which the monolithic tubular member (24) houses the spring (19) of the electromagnetic actuator (13).

4. An injector (1) as claimed in claim 3, in which the fixed armature (17) and the moving armature (18) of the electromagnetic actuator (13) have respective central holes (21, 22) which are coaxial, have the same dimension and house the spring (19) of the electromagnetic actuator (13).

5. An injector (1) as claimed in claim 4, in which the spring (19) of the electromagnetic actuator (13) is compressed between the shutter (9) and a drilled abutment body (20) which is disposed in a fixed position within the central hole (21) of the fixed armature (17).

6. An injector (1) as claimed in claim 1, in which the monolithic tubular member (24) houses the valve (6).

7. An injector (1) as claimed in claim 6, in which the shutter (9) of the valve (6) is welded to a wall of the moving armature (18) of the electromagnetic actuator (13).

8. An injector (1) as claimed in claim 7, in which the valve (6) comprises a valve seat (7) having a central injection hole (8), the shutter (9) comprising a plate (10) which has at least one peripheral supply hole (11) and a sealing member (12) which is circular in shape, projects from the plate (10) and is adapted to isolate the supply hole (11) from the injection hole (8) when the shutter (9) is urged to abut against the valve seat (7).

9. An injector (1) as claimed in claim 1, comprising an atomiser coupled to the valve (6).

10. An injector (1) as claimed in claim 1, comprising a non-return device interposed between the fixed armature (17) and the moving armature (18) of the electromagnetic actuator (13).

11. An injector (1) as claimed in claim 1, wherein between the section of the tubular member (24) and the section of the fixed armature (17) and the moving armature (18) there is a ratio of 1:4.

* * * * *